United States Patent [19]

Dickson

[11] 4,159,556

[45] Jul. 3, 1979

[54] SUSPENSION SYSTEM PRIMARILY DESIGNED FOR USE WITH OPERABLE WALLS AND PARTITIONS

[75] Inventor: Wesley B. Dickson, Brea, Calif.

[73] Assignee: Advanced Equipment Corporation, Anaheim, Calif.

[21] Appl. No.: 910,605

[22] Filed: May 30, 1978

[51] Int. Cl.[2] ..... A47H 13/00

[52] U.S. Cl. ..... 16/87.4 R; 16/88; 16/94 R; 49/409

[58] Field of Search ..... 16/87.4 R, 88, 89, 94 R, 16/95 R, 96 R, 97, 98; 49/409, 410, 411

[56] References Cited

U.S. PATENT DOCUMENTS

| | | | |
|---|---|---|---|
| 1,322,918 | 11/1919 | McQueen | 16/88 |
| 1,889,112 | 11/1932 | Shoemaker | 16/87 R |
| 3,042,960 | 7/1962 | Spork | 16/96 R |
| 4,073,092 | 2/1978 | Williams | 49/409 X |
| 4,080,686 | 3/1978 | Hagen | 16/88 |

FOREIGN PATENT DOCUMENTS

| | | | |
|---|---|---|---|
| 1321572 | 2/1963 | France | 16/87.6 R |

*Primary Examiner*—George H. Krizmanich

*Attorney, Agent, or Firm*—Edward D. O'Brian

[57] ABSTRACT

A suspension system primarily designed for use with operable walls and partitions can be constructed utilizing a plurality of identical tracks joined together in a system having a junction between such tracks and a trolley which is movable along the tracks and across the junction. Each of the tracks includes a pair of first spaced, parallel flanges and a second pair of spaced, parallel flanges located beneath the first pair. The trolley includes a bearing plate carrying a plurality of downwardly extending spherical bearings and a support plate located parallel to and underneath the bearing plate and the downwardly extending bearings. The trolley is adapted to be positioned in any of the tracks with bearings on the trolley supporting the trolley on the first pair of parallel flanges and with the support plate being located between the pairs of flanges. Adjacent to the junction upwardly extending spherical bearings are located on the second parallel flanges in locations in which they will engage and support the support plate and the trolley as the trolley is moved across the junction. An operable wall or panel or other similar item may be carried by the trolley.

6 Claims, 2 Drawing Figures

SUSPENSION SYSTEM PRIMARILY DESIGNED FOR USE WITH OPERABLE WALLS AND PARTITIONS

BACKGROUND OF THE INVENTION

The invention set forth in this specification pertains to a new and improved suspension system which is primarily designed for use with operable walls and partitions. The suspension system set forth in this specification is, however, capable of being utilized for other different, diverse purposes.

In the past quite a number of different suspension systems have been constructed and used for the purpose of supporting movable, operable walls or partitions and other diverse items. It is not considered that an understanding of this invention requires a detailed understanding of all such prior systems. They have been constructed so as to utilize rails or tracks mounted in an overhead, horizontal location so as to support a movable member or trolley.

Some such prior systems have been constructed so as to utilize a downwardly extending rail or track and a trolley or carriage engaging the exterior surfaces of such a rail so as to be movable along the length of such a rail. Where such rails join together it has been conventional to utilize rail junctions and switches which are roughly analogous to those which are employed in connection with railroad tracks.

As the art with respect to suspension systems of the type to which this invention pertains has advanced various systems have been developed utilizing essentially enclosed tracks or channels provided with bottom slots and utilizing a trolley or carriage located within the interior of such a track or channel and connected to an operable wall or other object by a member or rod extending downwardly through the slots. Such systems employing an enclosed carriage are considered desirable from an aesthetic standpoint. Also they are considered desirable inasmuch as they can be constructed so as to avoid the use of switching type mechanisms at junctions between the tracks employed.

Such suspension systems employing essentially enclosed tracks are only desirable when they utilize trolleys which can easily be moved across junctions between intersecting or branched tracks. As a result of this a number of different trolleys or carriages have been developed for use with essentially enclosed type track systems and frequently specialized tracks have also been developed and used with certain of such carriages.

On occasion such prior specialized trolleys or carriages for use with enclosed track suspension systems have utilized a large number of different spherical bearings mounted on a plate which is sufficiently large so as to bridge the gap between the slots on intersecting tracks. On occasion such systems have been constructed so as to utilize trolleys having several support elements at times engaging spaced flanges within such tracks during movement across the junctions between individual tracks. While such expedients are considered to be desirable and effective it is considered that there is a need for new and improved enclosed channel type suspension systems because of the lack of availability of such prior systems for use by different manufacturers.

SUMMARY OF THE INVENTION

An objective of the present invention is to fulfill the need indicated in the preceding discussion. A more specific objective of the invention is to provide a new and improved suspension system which is reasonably economic to manufacture, which is reasonably simple to construct, which may be easily and conveniently used without problems, particularly as the trolley employed with such a system moves past a junction between tracks, and which is capable of providing prolonged, satisfactory service with a minimum of maintenance.

In accordance with this invention the noted objectives are achieved by providing a suspension system including a track system having a junction between individual tracks and a trolley supported by the track system, the trolley being movable along the lengths of the tracks and from one track to another at the junction in which the improvement comprises: the trolley including a first plate, a second plate, connecting means connecting the plates so as to position the plates so that they are parallel to and spaced from one another and a plurality of downwardly extending spherical bearings mounted on the undersurface of the first plate, each of the tracks including two normally used flanges and holding means connecting the normally used flanges for holding these flanges so that they are spaced apart to define a slot extending between the flanges and so that they are parallel and in the same plane, said flanges of all of said tracks being located in the same plane, at least one of the downwardly extending spherical bearings resting on each of the flanges of one of the tracks with the connecting means extending through the slot when the trolley is not located at the junction, an upwardly extending spherical bearing located adjacent to each of the flanges of each of the tracks adjacent to the junction and mounting means connecting the upwardly extending spherical bearings with the tracks in positions in which the upwardly extending spherical bearings will engage the second plate so as to support the trolley as the trolley is moved across the junction.

BRIEF DESCRIPTION OF THE DRAWING

Because of the nature of this invention it is considered that it is best more fully described with reference to the remainder of this specification and the accompanying drawing in which.

Figure 1:
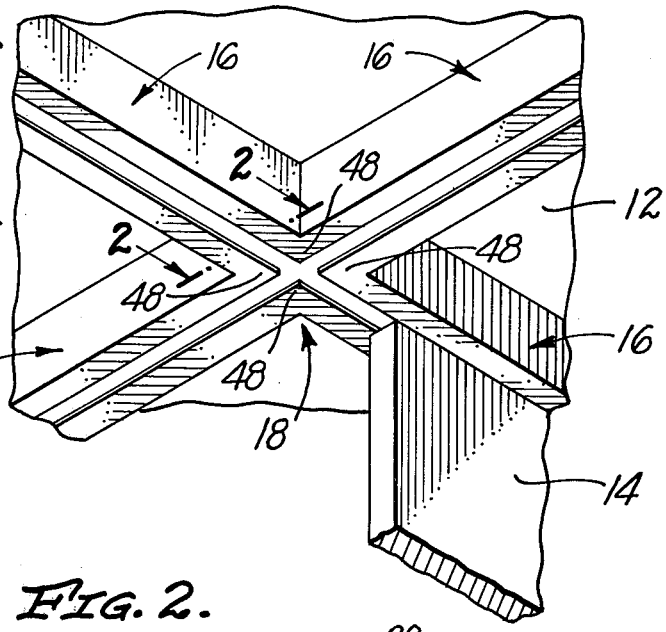
FIG. 1 is an isometric view showing a presently preferred embodiment or form of a suspension system in accordance with this invention installed upon a ceiling.
Figure 2:
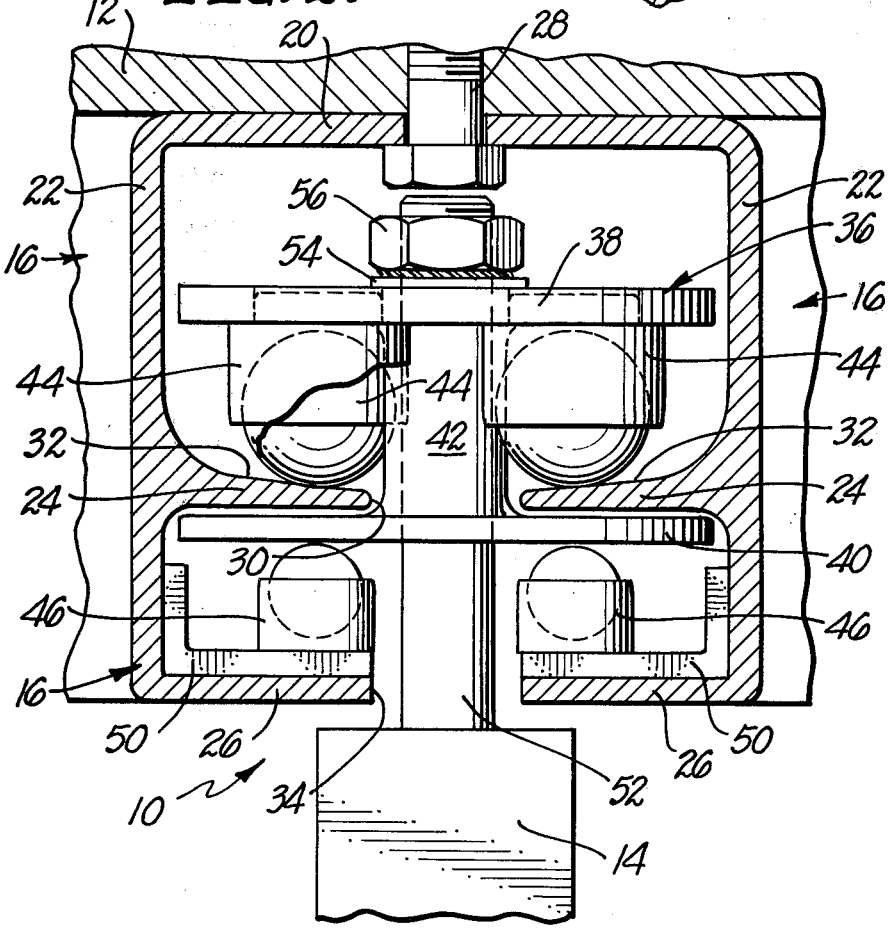
FIG. 2 is a cross-sectional view at an enlarged scale in which certain parts are shown in elevation taken at line 2—2 of FIG. 1.

The suspension system illustrated in the drawing is constructed so as to utilize the operative concepts or principles of the invention verbally expressed in the appended claims. These concepts or principles can be utilized in other somewhat differently appearing and differently constructed suspension systems through the use or exercise of routine mechanical engineering skill in the field of overhead suspension systems. For this reason the invention is not to be considered as being limited to the precise structure shown.

DETAILED DESCRIPTION

In the drawing there is illustrated a suspension system 10 which is mounted upon a ceiling 12 for the purpose of supporting one or more operable walls or partitions such as the wall 14 illustrated. It will be realized, of course, that the suspension system 10 can be employed for supporting various other different, diverse items. This suspension system 10 is of the enclosed track or channel type and employs a series of separate, identically formed tracks 16 which are connected in a conventional manner together at a "cross-over" type junction 18. The tracks 16 can of course be joined in other types of junctions such as for example a Y-type junction (not shown). As so assembled the tracks 16 constitute a "track system" (not separately numbered).

Each of the tracks 16 consists of a unitary member (not separately numbered) of a uniform, generally squarish cross-sectional configuration along its length constructed so as to include a top wall 20, parallel side walls 22, normally used flanges 24, and auxiliary flanges 26. The top wall 20 may be mounted upon the ceiling 12 or related support in any conventional manner, such as for example, through the use of conventional fasteners 28.

The flanges 24 are of identical construction and as utilized are located parallel to one another in the same plane (not separately numbered) and are spaced from one another so as to define an internal slot 30. Preferably these flanges 24 include slightly curved, sloping upper surfaces 32 for a purpose as hereinafter described which slope gradually downwardly toward the slot 30. The auxiliary flanges 26 are also located parallel to one another in the same plane (not separately numbered) and this plane is located beneath the plane in which the flanges 24 are located. These flanges 26 are also spaced from one another so as to define a slot 34 located between them which is positioned directly beneath the slot 30.

The suspension system 10 also includes a trolley or carriage 36 which is constructed so as to include a first disk-shaped rigid plate 38 and a second plate 40 of corresponding size and dimension which is located directly beneath the plate 38 and spaced from the plate 38. These plates 38 and 40 are held parallel and in axial alignment by means of a bearing sleeve 42 serving as a means for connecting these plates 38 and 40 together and holding them so that they are parallel to and spaced from one another.

At least four downwardly extending conventional spherical bearings 44 are mounted on the plate 38 in a conventional manner so as to extend downwardly from this plate 38. These bearings 44 are equally spaced from one another around the axis of the sleeve 42 and are preferably equally spaced from the axis of the sleeve 42. If desired, a greater number of the bearings 44 can be employed. The number of bearings 44 required will normally be such as to support the trolley 36 upon the flanges 24 at all times.

The surfaces 32 are engaged by these bearings 44. Because of their configuration they tend to "hold" or locate the trolley 36 so that it is centrally positioned between the side walls 22 in a position in which the sleeve 42 extends downwardly through the slot 30 between the flanges 24. By virtue of the configuration of the surfaces 32 when four of the bearings 44 are provided on the plate 38 the trolley 36 will normally move so that all four of these bearings 44 are supported on the surfaces 32.

It will be noted that when the trolley 36 is suspended in this manner that the plate 40 is located immediately below the flanges 24 and above the flanges 26. These flanges 26 are utilized to support upwardly extending spherical bearings 46 adjacent to each corner 48 of the junction 18. If desired to facilitate installation the bearings 46 may be mounted on the flanges 26 through the use of small angled plates 50 which are secured in place on the bearings 46 in any convenient manner such as through the use of an adhesive.

These bearings 46 must be positioned closely adjacent enough to the junction 18 so as to "pick up" and support the plate 40 and the entire trolley 36 as the trolley 36 approaches and moves across the junction 18. As this occurs the bearings 46 serve to carry the trolley 36 in such a manner that there is no danger of the bearings 44 becoming engaged within the slots 30 at or adjacent to the junction 18.

As a consequence of this the trolley 36 may be moved across the junction 18 with minimal difficulty with the plate 40 supporting the trolley 36 only during the time period when the trolley 36 is being moved in such a manner that there is danger of the bearings 44 "hanging up" in a slot 30. The action described here will normally involve a slight change in elevation of the trolley 36 during the time that this trolley 36 is moved with respect to the junction 18. Such change presents no difficulty because of the curvature of the bearings 44 and 46 employed.

In the system 10 the trolley 36 may be connected to the wall 14 in virtually any desired manner. In the structure shown an elongated bolt 52 attaches to the wall 14 so as to extend vertically through the sleeve 42 and is held against vertical movement by means of a washer 54 and a nut 56. Other equivalent structures can, of course, be employed.

I claim:

1. A suspension system including an elongated track system having a junction between individual tracks and a trolley supported by said track system, said trolley being movable along the length of said tracks and from one track to another at said junction in which the improvement comprises:

said trolley including a first plate, a second plate, connecting means connecting said plates so as to position said plates so that they are parallel to and spaced from one another, and a plurality of downwardly extending spherical bearings mounted on the undersurface of said first plate, each of said tracks including two normally used flanges located in the same plane and holding means connecting said normally used flanges for holding said flanges so that they are spaced apart to define a slot extending between said flanges and so that said flanges are parallel and in the same plane, said flanges of all of said tracks being located in the same plane, at least one of said downwardly extending spherical bearings resting on each of said flanges of one of said tracks with the connecting means extending through said slot of said one of said tracks when said trolley is not located at said junction, an upwardly extending spherical bearing located adjacent to each of said flanges of each of said tracks adjacent to said junction, and mounting means connecting said upwardly extending spherical bearings with said tracks in positions in which said upwardly extending spherical bearings will engage said second plate so as to support said trolley as said trolley is moved across said junction.

2. A suspension system as claimed in claim 1 wherein:

said mounting means comprise auxiliary flanges on each of said tracks, said auxiliary flanges being connected to said normally used flanges by said holding means and being held by said holding means so that said auxiliary flanges are spaced apart so as to define a slot between said auxiliary flanges which is vertically aligned with said slot between said normally used flanges and so that said auxiliary flanges are parallel and located in the same plane which is parallel to and spaced vertically from the plane in which said normally used flanges are located.

3. A suspension system as claimed in claim 2 wherein:

said first plate is located above said second plate and said normally used flanges are located above said auxiliary flanges.

4. A suspension system as claimed in claim 2 wherein:

said normally used flanges have sloping surfaces which slope downwardly toward said slot.

5. A suspension system as claimed in claim 1 wherein:

said normally used flanges have sloping surfaces which slope downwardly toward said slot, there are at least four of said downwardly extending spherical bearings, said sloping surfaces serving to position said trolley midway between said normally used flanges and serving to move said trolley so that more than one of said spherical bearings rides on each of said normally used flanges.

6. A suspension system as claimed in claim 1 wherein:

said normally used flanges have sloping surfaces which slope downwardly toward said slot, there are at least four of said downwardly extending spherical bearings, said sloping surfaces serving to position said trolley midway between said normally used flanges and serving to move said trolley so that more than one of said spherical bearings rides on each of said normally used flanges, said mounting means comprise auxiliary flanges on each of said tracks, said auxiliary flanges being connected to said normally used flanges by said holding means and being held by said holding means so that said auxiliary flanges are spaced apart so as to define a slot between said auxiliary flanges which is vertically aligned with said slot between said normally used flanges and so that said auxiliary flanges are parallel and located in the same plane which is parallel to and spaced vertically from the plane in which said normally used flanges are located, said first plate is located above said second plate and said normally used flanges are located above said auxiliary flanges.

* * * * *